United States Patent [19]

Hurst

[11] Patent Number: 4,518,127

[45] Date of Patent: May 21, 1985

[54] WEB SPLICING APPARATUS

[76] Inventor: Peter Hurst, 2 Fleethall Rd., Rochford, Essex, SS4 1NF, England

[21] Appl. No.: 475,488

[22] Filed: Mar. 15, 1983

[30] Foreign Application Priority Data

Mar. 31, 1982 [GB] United Kingdom ..... 8209478

[51] Int. Cl.[3] ..... B65H 19/10; B65H 19/18

[52] U.S. Cl. ..... 242/58.3; 156/504

[58] Field of Search ..... 242/58.3; 156/159, 504

[56] References Cited

U.S. PATENT DOCUMENTS

| | | | |
|---|---|---|---|
| 1,572,704 | 2/1926 | Carpenter | 242/58.3 |
| 1,767,728 | 6/1930 | Ball | 242/58.3 |
| 1,787,463 | 1/1931 | Wood | 242/58.3 |
| 1,924,583 | 6/1933 | Wood | 242/583 |
| 3,106,360 | 10/1963 | Kohler | 242/58.3 |
| 3,915,399 | 10/1975 | Kron et al. | 242/58.3 |
| 4,009,841 | 3/1977 | Matalia | 242/58.3 |

*Primary Examiner*—Stuart S. Levy
*Assistant Examiner*—Lloyd D. Doigan
*Attorney, Agent, or Firm*—Murray, Whisenhunt & Ferguson

[57] ABSTRACT

Web splicing apparatus for use in a reelstand having static positions for at least two reels comprising means for rotating a fresh reel on the reelstand, means for guiding a portion of the expiring web into a position adjacent to the periphery of the fresh reel, and means for moving the expiring web into contact with the periphery of the fresh reel to cause web splicing when the speeds of the fresh reel and the expiring web have been synchronized.

4 Claims, 8 Drawing Figures

WEB SPLICING APPARATUS

DESCRIPTION

Figure 1:
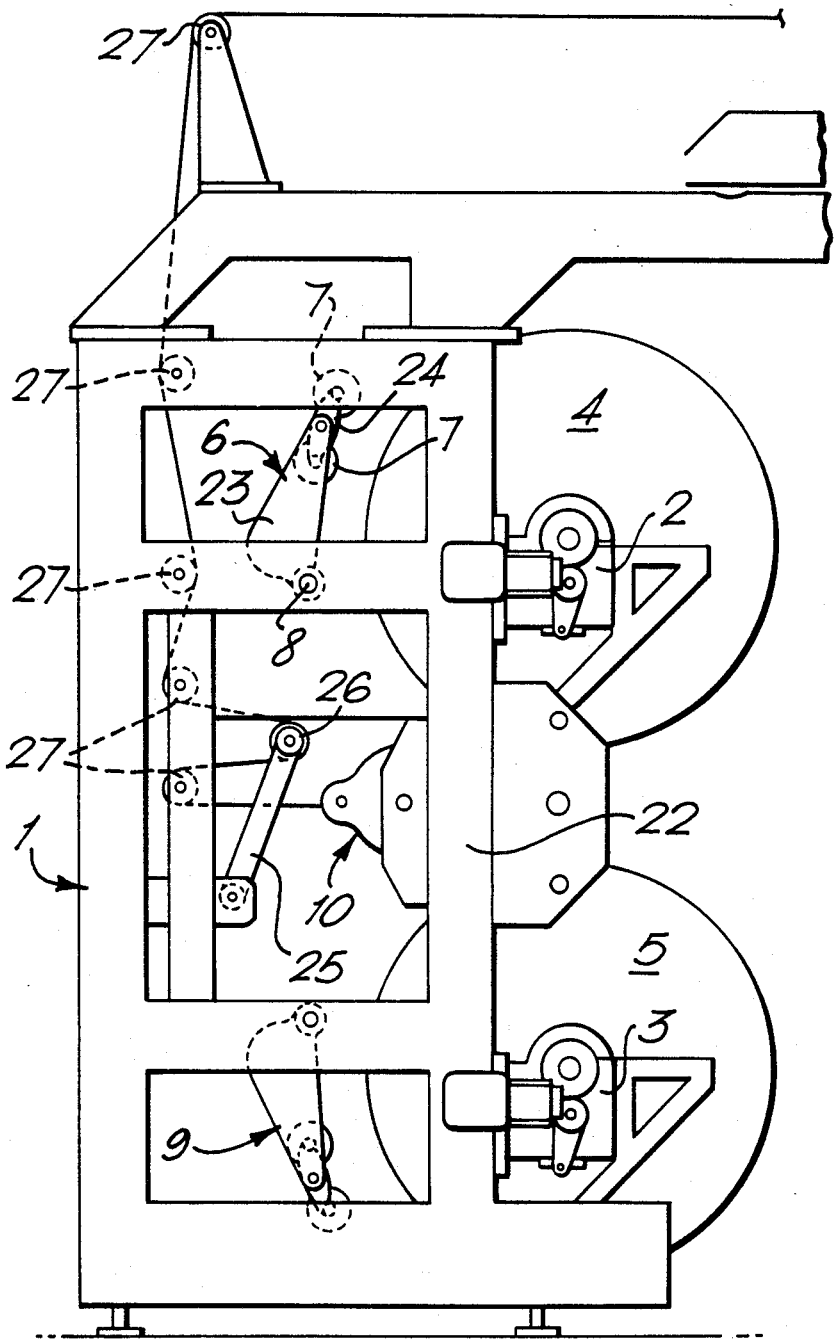

The invention relates to web splicing apparatus more particularly, but not exclusively intended for use in joining webs of newsprint at high speed.

Many devices are known whereby webs of paper and the like can be joined while they are moving at high speeds so that the production rate of the printing press to which the web is fed is not reduced or at least is not reduced to an unacceptable extent. Such devices are inevitably complex and thus expensive and are usually either of the so-called "zero paster" or "flying paster" kinds.

A "zero paster" usually involves storing a reservoir of web in a concertina-like festoon so that during splicing web is drawn from the reservoir rather than from the reel which can thus be stopped so that splicing of the end of the expiring reel to the end of a fresh reel can be achieved with the two webs stationary. Such zero pasters occupy a great deal of space and are thus difficult to accommodate particularly in printing installations in which several webs are simultaneously processed.

All fully automatic high speed flying pasters have hitherto had means for automatically moving reels of paper (which in the case of newsprint can weigh as much as three tonnes) from a loading position to a running position usually in a rotary path, although machines in which the reels are moved along a straight horizontal path are also known. In any event machines must be built to transport large weights and this fact alone has a substantial effect on the cost of the machine.

It is however known to provide a reelstand having fixed positions for two reels and in which reel changing is achieved by pressing the expiring (running) web against the stationary new reel by means of a swinging roller to provide a friction drive by means of which the new reel is accelerated from rest. Web joining occurs in this arrangement when paste applied to the leading edge of the new reel contacts the expiring web and this being the case the new reel cannot rotate through more than one revolution without the two webs becoming secured together. Since the tensile strength of the running web is limited, and the inertia of the new reel large, and inevitable result of the acceleration of the new reel having to take place in less than one revolution is that there is insufficient time to drive the new reel up to high speed, so that when using this method the printing press must be slowed to a crawl before the reels can be changed. As previously mentioned, slowing of the printing press is undesirable since it results in lost production.

It is an object of the invention to provide web splicing apparatus capable of operating at high web speeds, which obviates the need for expensive apparatus for moving heavy reels of paper automatically from a loading to a running position, which is compact so that the space requirements of a reelstand incorporating the web splicer are minimised, and which is relatively simple in design and thus relatively inexpensive to produce.

According to the invention there is provided web splicing apparatus for use in a reelstand having static positions for at least two reels comprising means for rotating a fresh reel on the reelstand so that the peripheral speed of the fresh reel is equivalent to the running speed of the expiring web, means for guiding a portion of the expiring web into a position adjacent to the periphery of the fresh reel, means preferably in the form of a brush for moving the expiring web into contact with the periphery of the fresh reel to cause web splicing when the speeds of the fresh reel and the expiring web have been synchronised, and means for severing the expiring web after splicing.

Preferably the means for guiding the expiring web into a position adjacent to the fresh reel is such that a length of the expiring web is presented to the fresh reel. The guiding means may comprise a set of four guide members which are mounted parallel to one another in a substantially rectangular configuration, the guide members being equispaced about and parallel to an axis around which the guide members are arranged for limited orbital movement.

The web guide means is preferably mounted in the reelstand on a parallel motion linkage to ensure that the length of expiring web is presented to the fresh reel at a constant angle irrespective of the diameter of the fresh reel, and preferably the four guide members comprise two pairs with a web splicing brush disposed between each pair.

Advantageously the web guiding means comprises a carrier mounted on the parallel motion linkage, a sub-carrier rotatably mounted on the carrier, the set of guide members being mounted on the sub-carrier for orbital motion about the axis of rotation of the sub-carrier between a rest position in which the expiring web passes between one pair of the guide members and the other pair of the guide members, and a position in which the expiring web is constrained to follow a sinuous path about the guide means and in which the web splicing brush is brought into proximity to the presented length of the expiring web. If desired the sub-carrier may comprise a pair of externally toothed wheels between which the guide members are disposed, the externally toothed wheels being interconnected to resist twisting of the guide members.

Figure 2:
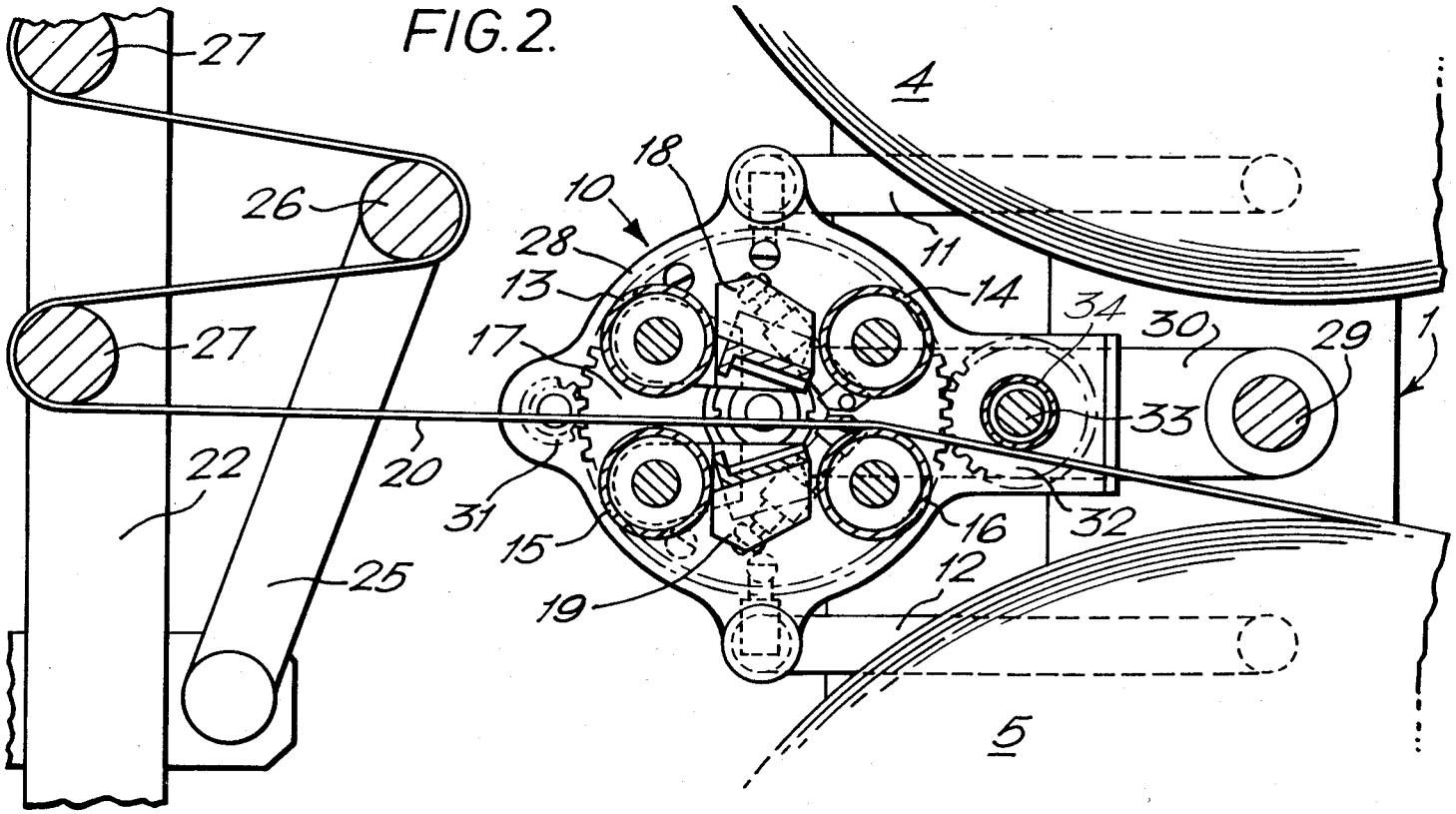
Figure 3:
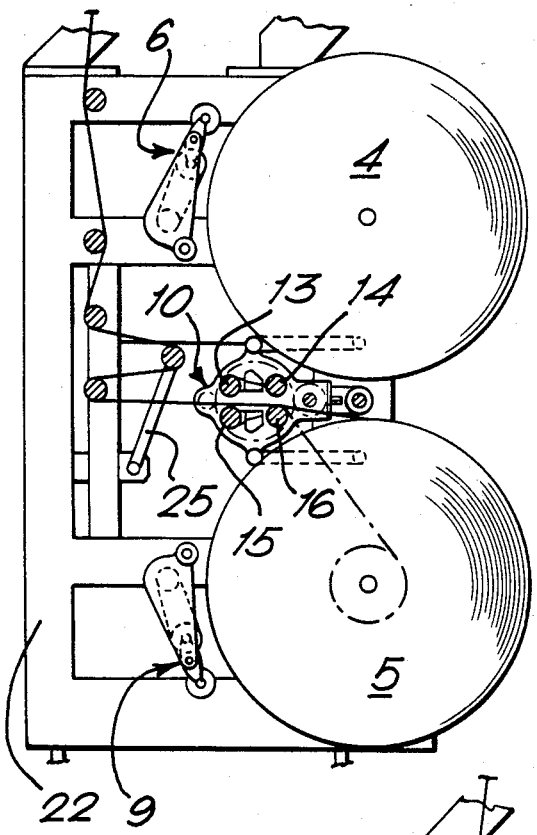
Figure 4:
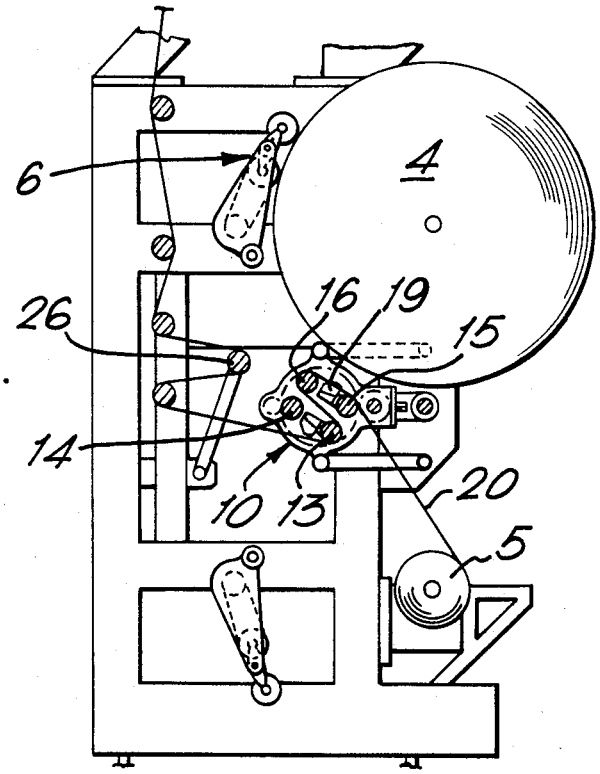
Figure 5:
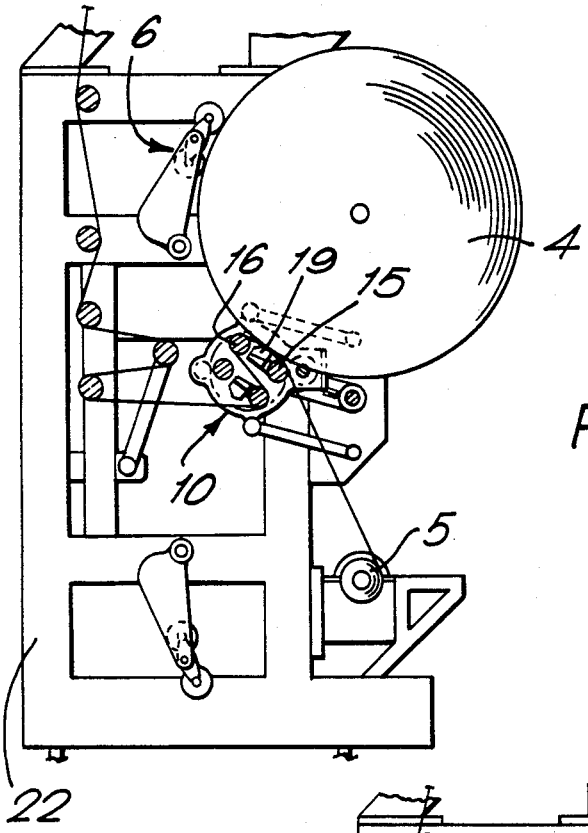
Figure 6:
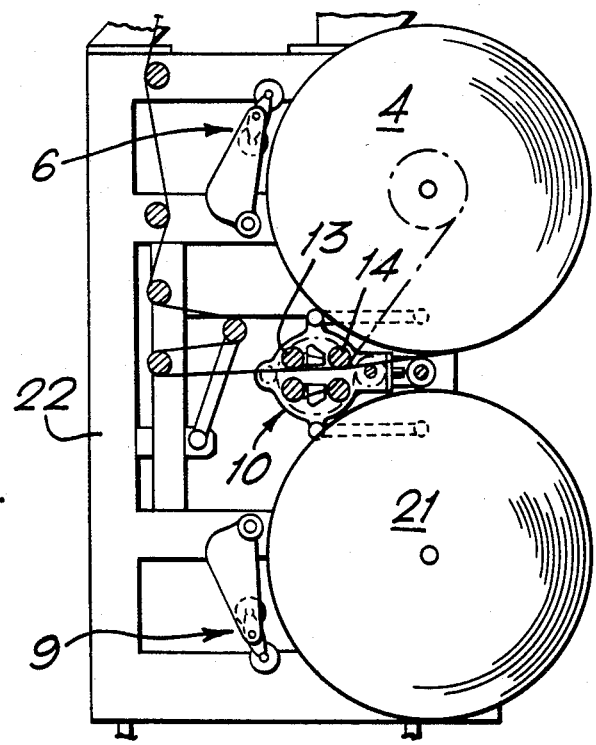
Figure 7:
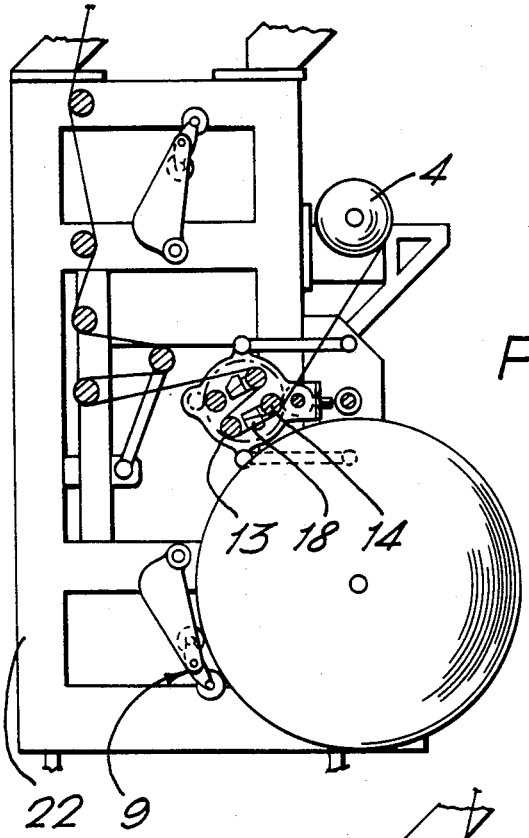
Figure 8:
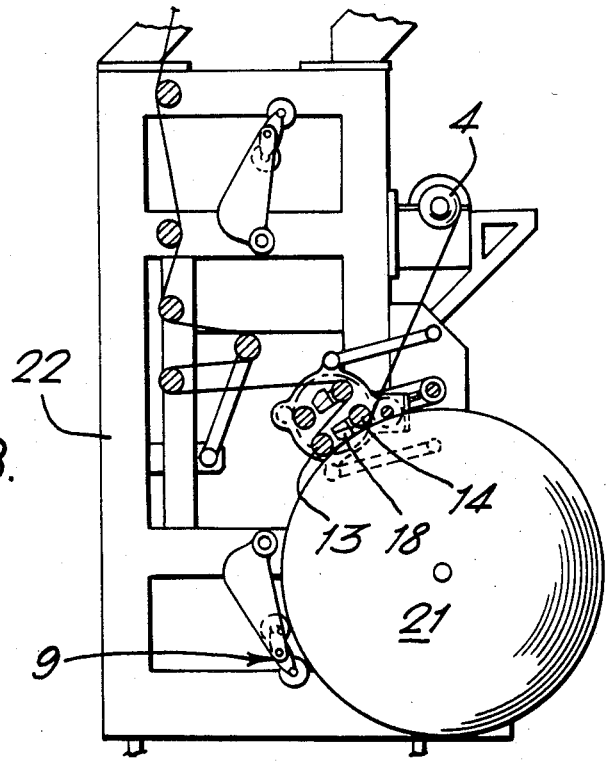

The invention is diagrammatically illustrated by way of example in the accompanying drawings in which:

FIG. 1 is a side elevation of a two position reelstand for a printing press, FIG. 2 is an enlarged side view of part of the reelstand of FIG. 1, FIG. 3 is a diagrammatic view corresponding to FIG. 1 and showing the reelstand in a first position, FIG. 4 is a side view corresponding to FIG. 3 and showing the reelstand in a second position, FIG. 5 is a side elevation corresponding to FIG. 3 and showing the reelstand in a third position, FIG. 6 is a side elevation corresponding to FIG. 3 and showing the reelstand in a fourth position, FIG. 7 is a side elevation corresponding to FIG. 3 and showing the reelstand in a fifth position, and FIG. 8 is a side elevation corresponding to FIG. 3 and showing the reelstand in a sixth position of operation.

In the drawings there is shown a reelstand 1 comprising a frame 22 which is formed with upper and lower fixed, that is to say static, supports 2 and 3 respectively for respective upper and lower reels of paper 4 and 5. In association with the upper support 2 there is provided a reel driving mechanism generally indicated at 6 and which may be of a kind known per se the mechanism comprising a pair of power driven rollers 7 which may be engaged with the periphery of the reel of paper 4 in order to drive the reel of paper in rotation. For this purpose the mechanism 6 comprises an arm 23 on one end of which is pivoted a bogie 24 carrying the power driven rollers 7, the arm 23 being pivoted about an axle 8 on the frame 22 whereby the mechanism 6 may be moved from the disengaged position shown in FIG. 1 of the drawings to a position shown for example in FIG. 4 in which the rollers 7 frictionally engage the periphery of the reel of paper 4. In similar fashion the lower reel support 3 has associated therewith a reel driving mechanism generally indicated at 9 for engaging and rotating the reel of paper 5. The mechanism 9 is preferably identical to that described above with reference to the upper reel support 2.

In order to effect a splice between the moving web of paper from an expiring reel and a fresh reel at high speed the reelstand incorporates web splicing means 10 which is best illustrated in FIG. 2 of the drawings. The web splicing means comprises a carrier 28 pivotally mounted on a parallel pair of arms 30 which are journalled at 29 on the frame 22, (only one of the arms being visible of the drawings) the carrier also being connected to the frame 22 by pairs of parallel links 11 and 12 respectively so that the carrier 28 may be swung either towards the reel 4 or the reel 5 without affecting the attitude of the web splicer 10 with respect to the peripheries of the reels. The web splicer 10 may be swung on the arms 30 and the links 11 and 12 by any convenient means such as by means of an electric motor operating through a chain and sprocket mechanism (not shown). Rotatably mounted on the carrier 28 are a pair of sub-carriers 17 (only one of which is seen in the drawings) between which is mounted a group of four parallel web guiding rollers 13 to 16 inclusive the rollers being arranged in a generally square formation and for orbital movement about the axis of rotation of the sub-carrier 17, which axis is disposed substantially centrally of the group of four rollers. As can be seen in FIG. 2, the sub-carriers 17 are toothed around their peripheries to resemble sun gears and the teeth of one of the sub-carriers are engaged by the toothed drive sprocket 31 of an electric motor (not shown) so that the sub-carriers 17 and thus the rollers 13 to 16 can be rotated on the carrier 28. To prevent twisting of the sub-carrier assembly when it is driven in rotation, the two sub-carriers are interconnected by gears 32 which are coupled by a shaft 33. A web guide roller 34 is concentric with the shaft 33 and has associated therewith a web severing device (not shown) which may be of a kind known per se.

A web splicing brush 18 is carried between the sub-carriers and is disposed between the upper pair of rollers 13 and 14 and similarly a web splicing brush 19 is disposed between the lower pair of rollers 15 and 16. The brushes 18 and 19 may be of a kind known per se and are adapted to be moved from an inoperative position to an operative position in which they force the running web into contact with the free end of the fresh web whereby the two webs are joined together in the manner described below.

As will be seen in FIGS. 2 and 3 the web of paper from the reel 5 is arranged when the web splicer 10 is in its inoperative position to pass close to the guide roller 34, between the upper and lower pairs of rollers of the web splicing device, over a guide 27, over a so-called "dancing roller" 26 mounted on a pivoted arm 25 by means of which the tension in the web can be adjusted in any desired fashion after which the web passes over a series of guides 27 on its way to a printing press.

FIG. 3 shows the apparatus with two full reels of paper and with the splicer in its rest position in which it is centrally disposed between the reels.

Referring to FIG. 4 when the reel 5 reaches expiry the group of four rollers 13 to 16 of the web splicing device is rotated anti-clockwise as shown in FIG. 4 through approximately 135° so that the web of paper 20 is wrapped about the rollers in sinuous fashion so that the web brush 19 is brought close to the web of paper. At the same time the reel speed-up mechanism 6 is brought into contact with the periphery of the fresh reel 4 so that the reel is driven in rotation. It should here be explained that the fresh reel 4 is first prepared in conventional fashion with a paste pattern on its leading edge and with a metallic marker strip whereby the speed of rotation of the fresh reel can be measured and synchronised with that of the expiring web and the position of the leading edge determined.

As shown in FIG. 5 of the drawings the web splicer 10 is then moved vertically upwardly into the vicinity of the fresh reel 4 although it will be noted that a small gap is maintained between the periphery of the reel and the web 20 wound round the rollers 15 and 16. When the speeds of the expiring web 20 and the periphery of the fresh reel have been synchronised the web splicing brush 19 is actuated to move the running web into contact with the paste pattern on the fresh reel to effect web splicing. Subsequently the web severing knife is actuated in conventional fashion to sever the old web 20. The web splicer 10 then moves to its rest position as shown in FIG. 6 of the drawings and the rollers 13 to 16 are rotated in a clockwise direction to permit the fresh web of paper from the reel 4 to pass between the upper pair 13 and 14 and the lower pair 15 and 16 of rollers is a substantially straight path. A new reel 21 is then loaded into the stand to replace the expired reel 5.

When the reel 4 nears expiry the rollers 13 to 16 are rotated clockwise into the position shown in FIG. 7 in which the web of paper is wrapped in sinuous fashion about the rollers and in which the web is brought close to the splicing brush 18. Web splicing from the expiring web of the reel 4 to the fresh reel 21 then proceeds as described above.

I claim:

1. Web splicing apparatus for use in a reelstand having static positions for at least two reels, said apparatus comprising means for rotating a fresh reel on the reelstand, web guiding means for guiding a portion of an expiring web into a position adjacent to the periphery of the fresh reel, and web moving means for moving the expiring web into contact with the periphery of the fresh reel to cause web splicing when the speeds of the fresh reel and the expiring web have been synchronized, the web guiding means comprising a carrier, means mounting the carrier for movement between the reels, a sub-carrier rotatably mounted on the carrier, a set of guide members mounted on the sub-carrier for orbital motion about the axis of rotation of the sub-carrier, the guide members being mounted parallel to one another in a substantially rectangular configuration and being equispaced about and parallel to the said axis, the set of guide members comprising two pairs of guide members, the web moving means comprising a web moving device associated with each said pair of guide members, the guide members being moveable between a rest position in which the expiring web passes between one pair of the guide members and the other pair of the guide members, and a position in which the expiring web is constrained to follow a sinuous path about the guide members in which position one pair of the guide members presents a length of the expiring web to the fresh reel and the associated web moving device is brought into proximity to the presented length of the expiring web.

2. Web splicing apparatus according to claim 1, wherein the means mounting the carrier for movement between the reels comprises a parallel motion linkage which ensures that the length of the expiring web presented to the fresh reel is at a fixed angle irrespective of the diameter of the fresh reel.

3. Web splicing apparatus according to claim 1, wherein the sub-carrier comprises a pair of externally toothed wheels between which the guide members are disposed, and means for interconnecting the externally toothed wheels to resist twisting of the guide members.

4. Web splicing apparatus according to claim 1, wherein each web moving device comprises web splicing brush means.

* * * * *